US005569507A

United States Patent [19]

Goodwin et al.

[11] Patent Number: 5,569,507

[45] Date of Patent: Oct. 29, 1996

[54] PROTECTIVE COVERS WITH VIRUS IMPENETRABLE SEAMS

[75] Inventors: Brent I. Goodwin, Elkton, Md.; Francis J. Masley, Wilmington, Del.

[73] Assignee: W. L. Gore & Associates, Inc., Newark, Del.

[21] Appl. No.: 396,300

[22] Filed: Feb. 28, 1995

[51] Int. Cl.[6] ..... B32B 1/04

[52] U.S. Cl. ..... 428/76; 156/267; 156/269; 156/290; 156/291; 156/295; 428/68; 428/192; 428/193; 428/246; 428/252; 428/253; 428/284; 428/286; 428/421; 428/422

[58] Field of Search ..... 428/198, 68, 76, 428/246, 253, 284, 304.4, 910, 57, 252, 286, 287, 296, 421, 422, 192, 193; 156/267, 269, 290, 291, 295

[56] References Cited

U.S. PATENT DOCUMENTS

| | | | |
|---|---|---|---|
| 2,460,460 | 2/1949 | Langer | 154/42 |
| 2,950,482 | 8/1960 | Withers | 2/169 |
| 2,957,513 | 10/1960 | Schneider et al. | 154/42 |
| 3,028,576 | 4/1962 | Gerard | 156/251 |
| 3,124,807 | 3/1964 | Frenkel et al. | 3/169 |
| 3,147,493 | 9/1964 | Winson | 2/158 |
| 3,387,307 | 6/1968 | Flatz | 2/167 |
| 3,528,867 | 9/1970 | Leatherman et al. | 156/272 |
| 3,567,544 | 3/1971 | Nichols | 156/176 |
| 3,625,790 | 12/1971 | Ayres | 156/93 |
| 3,701,167 | 10/1972 | Spetz | 2/266 |
| 3,755,033 | 8/1973 | Emus | 156/88 |
| 3,793,647 | 2/1974 | Spetz | 2/266 |
| 3,866,245 | 2/1975 | Sutherland | 2/169 |
| 3,923,577 | 12/1975 | Baab | 156/251 |
| 3,945,049 | 3/1976 | Barlow | 2/169 |
| 3,953,566 | 4/1976 | Gore | 264/288 |
| 3,962,153 | 6/1976 | Gore | 260/2.5 R |
| 4,054,706 | 10/1977 | Shapiro | 428/213 |
| 4,096,227 | 6/1978 | Gore | 264/210 |
| 4,143,424 | 3/1979 | Knoke et al. | 2/255 |
| 4,187,390 | 2/1980 | Gore | 174/102 R |
| 4,194,041 | 3/1980 | Gore et al. | 428/315 |
| 4,209,857 | 7/1980 | Clark, Jr. et al. | 2/169 |
| 4,211,806 | 7/1980 | Civardi et al. | 428/91 |
| 4,263,727 | 4/1981 | Bender et al. | 36/44 |
| 4,333,980 | 6/1982 | Russell | 428/192 |
| 4,366,579 | 1/1983 | Noguchi | 2/19 |
| 4,392,257 | 7/1983 | Furga | 2/105 |
| 4,441,213 | 4/1984 | Trumble et al. | 2/161 R |
| 4,602,442 | 7/1986 | Revill et al. | 36/44 |
| 4,645,629 | 2/1987 | Stern | 264/23 |
| 4,733,413 | 3/1988 | Dykstra | 2/169 |
| 4,797,253 | 1/1989 | Petersen | 428/196 |
| 4,833,733 | 5/1989 | Welch et al. | 2/169 |
| 4,845,785 | 7/1989 | Allen | 2/268 |
| 4,847,918 | 7/1989 | Sturm | 2/161 R |
| 4,918,754 | 4/1990 | Leatherman et al. | 2/16 |
| 5,342,673 | 8/1994 | Bowman et al. | 428/198 |

FOREIGN PATENT DOCUMENTS

| | | |
|---|---|---|
| 0345730 | 12/1989 | European Pat. Off. . |
| 252795A1 | 12/1987 | Germany . |
| 8714816.1 | 7/1988 | Netherlands . |
| 1465343 | 2/1977 | United Kingdom . |
| 88/03068 | 5/1988 | WIPO . |
| 9000180 | 1/1990 | WIPO . |

OTHER PUBLICATIONS

ASTM–ES22–92, "Emergency Standard Test Method For Resistance of Protective Clothing Materials to Penetration by Blood–Borne Pathogens Using Viral Penetration as a Test System[1, 2]".

*Primary Examiner*—James J. Bell

[57] ABSTRACT

The present invention is an improved protective cover for use in shielding against contamination or infection, such as through contact with viruses. The present invention identifies previously ignored voids in seams as a chief cause of failure in protective garments and other covers in shielding against virus penetration. By sealing the seams with adhesive so as to fully encapsulate fibers therein and reduce void size to less than 10 micron, the risk of virus penetration is eliminated.

14 Claims, 4 Drawing Sheets

PROTECTIVE COVERS WITH VIRUS IMPENETRABLE SEAMS

BACKGROUND OF THE INVENTION

1. Field of the Invention

The present invention relates to garments and other covers used to protect against microscopic or sub-microscopic contaminants, such as viruses.

2. Description of Related Art

Health care professionals and others are regularly exposed to a wide number of serious infectious microbes in their work places. While at one time face masks and gloves were provided to health care professionals primarily to protect patients from infection during operations, concerns about the health of both patients and workers has greatly expanded the use of such barriers today. As a result, many workers are now forced to wear protective gloves for long periods during their regular duties.

Conventional gloves made from silicone or other "rubber" elastomer have proven to be relatively good protective barriers. These products are quite impermeable to most contaminants and are inexpensive enough to be discarded after each use. However, rubber gloves have a number of deficiencies, including being impermeable to moisture vapor (making them very uncomfortable to wear for long periods of time), being subject to deterioration when exposed to certain chemicals or other adverse environmental conditions, and being prone to puncture and tears.

One answer to the uncomfortable nature of conventional rubber gloves is to employ gloves made from a waterproof and breathable material, such as expanded polytetrafluoroethylene (PTFE) made in accordance with U.S. Pat. No. 3,953,566 to Gore. Expanded PTFE as a membrane comprises a lattice of polymeric nodes and interconnected fibrils that creates an effective microporous barrier. This barrier repels water and other liquids while allowing moisture vapor to escape. More importantly for use in health care applications, a barrier of expanded PTFE has been demonstrated to be quite effective at isolating contaminants, such as microorganisms.

Gloves, glove inserts, masks and gowns made from expanded PTFE and fabric composites are commercially available under the trademark GORETEX from W. L. Gore & Associates, Inc., Newark, Del. For many uses these gloves are considered to be the state-of-the-art in waterproof/breathable protection. Despite their effectiveness in a wide variety of applications, it has now been determined that at least certain gloves made from this composite do not consistently pass certain tests for microbial protection. While these gloves are thoroughly waterproof through both the membrane and the seams, according to certain tests it has been determined that viruses can penetrate through these gloves. Further study has demonstrated that, although the composite material in these gloves does present a successful shield, surprisingly it is the seams of these gloves that are prone to virus leakage.

Conventional seams in expanded PTFE and fabric composites are generally formed by applying a bead of adhesive between fabric layers and sealing the seams together, sometimes under some elevated heat and pressure. Another approach in seam construction is to apply high heat and pressure to a polymeric coating so as to melt-flow and bond two layers together. Despite the effectiveness of these approaches in avoiding water penetration, it has been determined that these seams are not effective strong barriers to sub-microscopic contaminants, such as viruses suspended in a body fluid simulant (42±2 dynes/cm).

Accordingly, it is a primary purpose of the present invention to provide an improved protective cover that is comfortable to wear yet provides an effective barrier to virus penetration.

It is a further purpose of the present invention to provide a protective cover that has seams that are resistant to virus penetration.

These and other purposes of the present invention will become evident from review of the following specification.

SUMMARY OF THE INVENTION

The present invention is an improved protective cover for use in separating a wearer from microscopic or sub-microscopic contaminants, such as viruses. The cover of the present invention comprises a composite material of microporous film that is attached to a fibrous (e.g., knit, woven, or nonwoven) material. To produce a cover of a particular shape, such as a glove or bootie, the composite is sealed to itself along seams to make the desired shapes and then is cut to a particular shape. The sealing process of the seams has been determined to be particularly important, since a primary passageway for the leakage of contaminants is through voids in the seams themselves. The seams of the present invention fully encapsulate fibers in the fibrous material with a continuous adhesive layer, reducing or eliminating any passageways therethrough. The encapsulation process of the present invention leaves typical voids of less than 10 microns in diameter.

Seams made in accordance with the present invention are not only waterproof, but also are resistant to penetration by viruses and similar contaminates. Unlike previous attempts to produce virus-proof garments and other covers using expanded PTFE membranes and like material, the protective cover of the present invention will consistently pass virus resistance tests, such as ASTM Standard ES22.

The protective cover of the present invention retains all the features of expanded PTFE laminated garments, including waterproofness and breathability, while also stopping penetration of viruses.

DESCRIPTION OF THE DRAWINGS

The operation of the present invention should become apparent from the following description when considered in conjunction with the accompanying drawings, in which.

DETAILED DESCRIPTION OF THE INVENTION

The present invention is an improved protective cover particularly suitable for use in environments where contacts with microscopic or submicroscopic contamination, such as viruses, must be avoided. While the cover of the present invention may comprise any desired shape and size, it is particularly intended to serve as a protective garment, such as a glove or boot.

Figure 1:
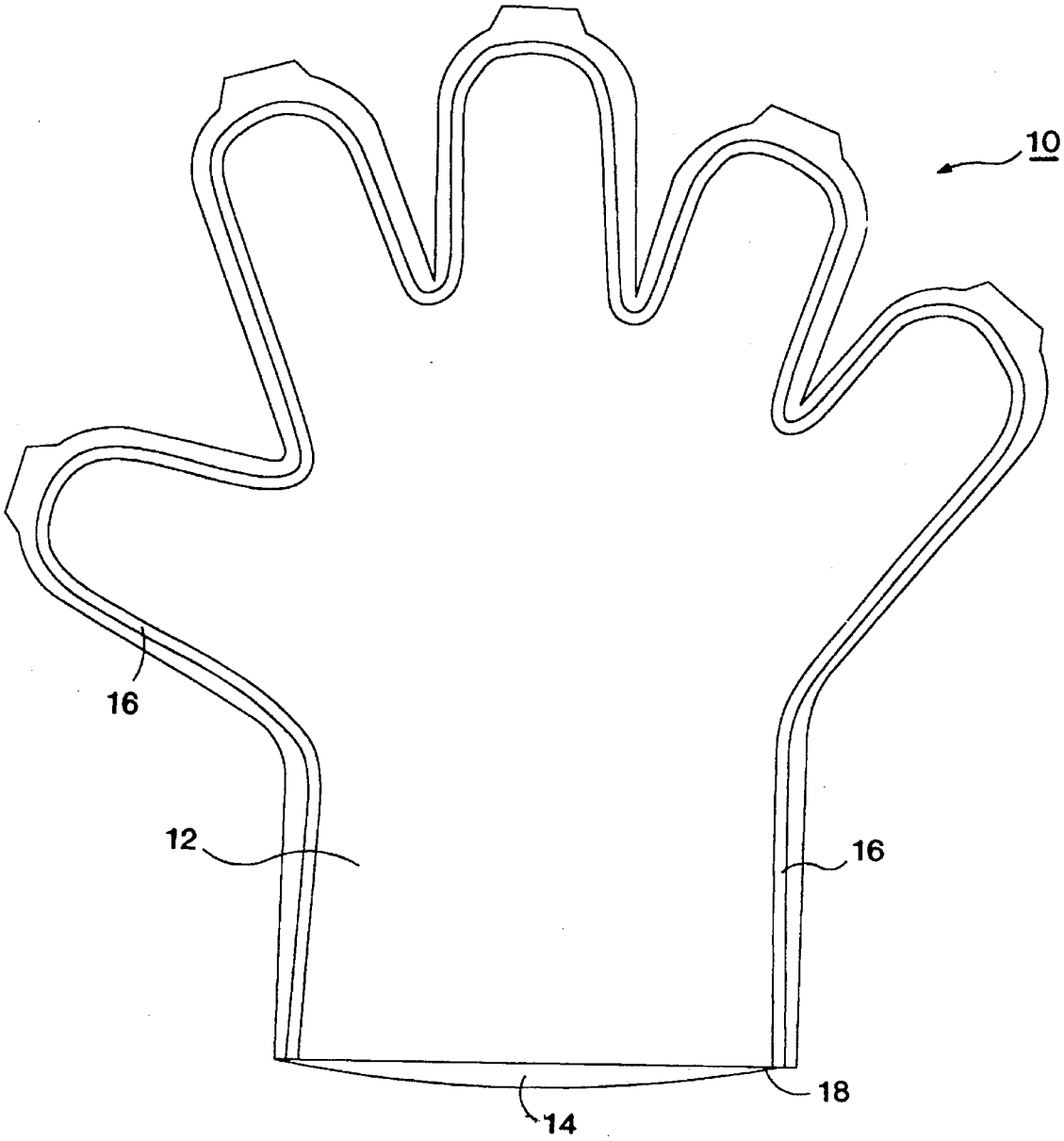
FIG. 1 is a plan view of a glove incorporating the present invention.

Shown in FIG. 1 is a protective cover of the present invention in the form of a glove 10. This glove comprises two mirror image sheets 12, 14 of composite membrane material in the approximate shape of a human hand that are bonded together along seam line 16. The seam 16 extends around most of the glove outline, with one end 18 left open for insertion of a hand or lining material.

The composite membrane material preferably comprises a porous expanded polytetrafluoroethylene (PTFE) film laminated to a backing material. The basic construction and properties of expanded PTFE are described in a number of references, including U.S. Pat. Nos. 3,953,566 to Gore, 3,962,153 to Gore, 4,096,227 to Gore, and 4,187,390 to Gore, all incorporated by reference. This material comprises a microscopic matrix of polymeric nodes interconnected by fibrils. This matrix or "lattice" structure produces a unique material that has billions of micro-pores per square inch. Water droplets will not penetrate this material, but moisture vapor will. Thus, the membrane combines the divergent properties of being both waterproof and moisture vapor permeable which we refer to as "breathable."

In order to avoid compromise of the membrane from perspiration, chemicals, or other contaminants, a number of further processes have been developed to provide an oleophobic coating on the membrane. Such coatings are described in U.S. Pat. No. 4,194,041 to Gore et al. and PCT publication WO 90/00180 to Sakhpara, both incorporated by reference. While such coatings may somewhat diminish breathability, they are considered important for maintaining long-term durability of the membrane.

Since the membrane alone may be subject to damage or stretching and distortion, the present invention employs a composite whereby the membrane is laminated to a dimensionally stable backing material. Suitable materials include knits, lightweight multifilament knits, monofilament knits, nonwoven and woven structures of nylon, polypropylene, cotton, polyester, fire resistant fabrics.

Preferably, lamination is accomplished by adhering the backing material to the oleophobic coated PTFE film with discrete adhesive dots. A second layer of material can be laminated to the opposite side to form a 3 layer laminate. Suitable materials for this second layer include knits, lightweight multifilament knits, monofilament knits, non-woven, and woven structures of nylon, polypropylene, cotton, polyester, fire resistant fabrics.

Once the composite material is formed, the material may be cut into any desired shape and size. As has been noted, in the embodiment shown in FIG. 1, the composite material comprises two hand shaped sheets 12, 14, each a mirror image of the other, sized approximately 0% to 100% larger than the hand of the intended wearer. In order to produce a protective cover 10 of the present invention, the two sheets 12, 14 are then bonded together in a manner to produce an impenetrable seam 16 between the two sheets 12, 14. It is preferred that the backing layers are mounted facing one another for a number of reasons. First, the backing material serves to shield and protect the expanded PTFE membrane from accidental damage when the cover is donned or removed. This is particularly suitable in those instances where the cover is worn with another covering over it that will protect the expanded PTFE from external damage. Second, the backing material will more readily bond to itself using a wider variety of sealants than the expanded PTFE will bond to itself. Accordingly, it has been found that a more secure seam can be produced where a backing material to backing material interface has been formed. While this strategy of mounting backing material to backing material has proven quite effective in producing waterproof seams, seams made in this manner have failed to pass virus resistant barrier tests, as is explained in detail below.

In the course of developing the present invention, conventional seams were produced using a low pressing temperature to make 5 mm wide bead of thermoplastic polyurethane adhesive, like ESTANE, from B.F. Goodrich of Brecksville, Ohio, TEXIN from Miles, Inc. of Pittsburgh, Pa., or PELLETHANE from Dow Plastics of Midland, Mich., with viscosities less than 2000 poise at operation temperatures below 190° C. have been used successfully. The seam can be formed using bulk melter/applicators available from Meltex Corporation of Peachtree, Ga., Graco Inc. of Minneapolis, Minn., or Nordson Corporation of Atlanta, Ga. This process causes the adhesive layer to flow around the fibers of the backing material so as to produce a waterproof barrier layer. However, when this material was tested in accordance with ASTM Standard ES22, as outlined below, many of the seams produced with this process failed. Although such failure was not initially understood, the reason for such failure can be appreciated through examination of scanning electron micrographs (SEMs) of these seams.

Figure 2:
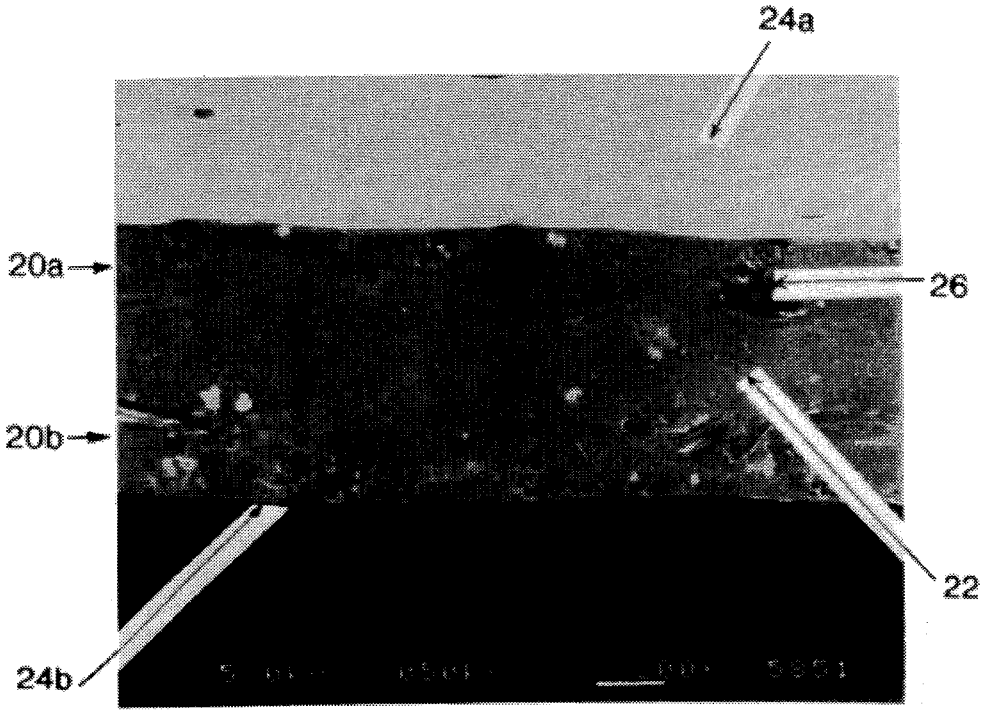
FIG. 2 is a scanning electron micrograph (SEM) enlarged 50 times of a cross-section of a seam from a commercially available glove.
Figure 3:
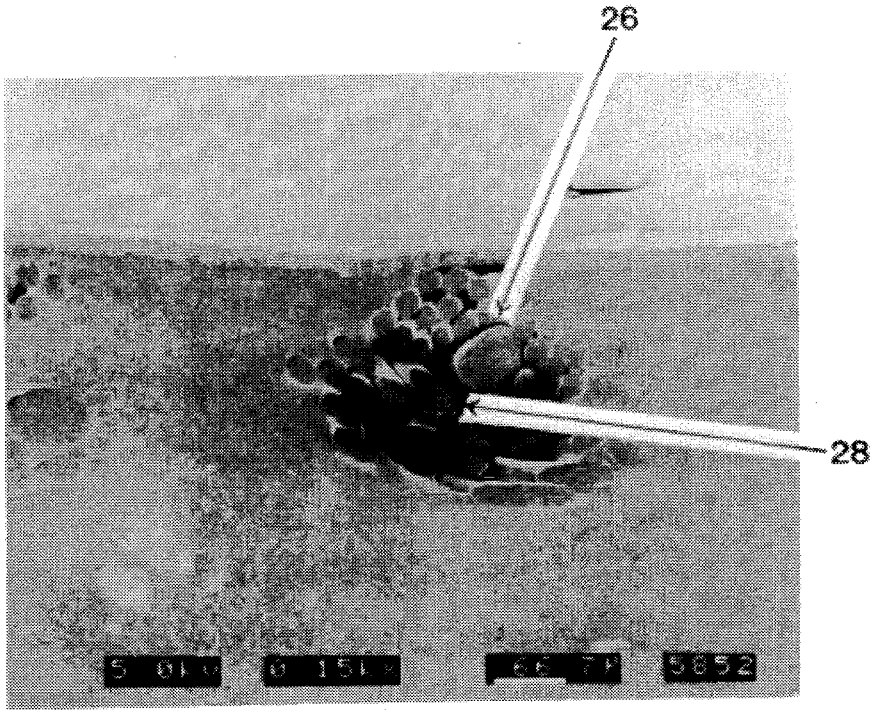
FIG. 3 is an SEM enlarged 150 times of a portion of the seam shown in FIG. 2.

FIGS. 2 and 3 are SEMs of a failed seam produced in accordance with the above described method. These seams compose two knit backing layers 20*a*, 20*b* adhered together and permeated with an adhesive 22. The backing layers 20*a*, 20*b* are each adhered to an expanded PTFE membrane 24*a*, 24*b*. Numerous fiber bundles 26 run through the backing layer 20 and these are surrounded by the adhesive material. Unfortunately, as can be better seen in the SEM of FIG. 3, the adhesive layer fails to permeate inside of the fiber bundle 26, providing a microscopic passageway 28 through the seam. These voids are approximately 15 to 20 or more microns in diameter. Although factors such as surface tension and a tortuous pathway may prevent water from readily permeating through the seam via these passageways in a conventional dunk test, it is believed that viruses suspended in a body fluid simulant are able to cross the protective barrier by permeating these gaps in the seams.

To address this concern, the present invention produces a seam in a significantly different manner. In the present invention, seams are produced using a higher pressing temperature for a continuous bead of adhesive. Suitable adhesives for use with the present invention include: ESTANE, TEXIN, PELLETHANE, MORTHANE from Morton International of Reading, Pa.; or thermoplastic polyurethane; or MOR-AD from Morton, SUPER GRIP from Bostik of Middleton, Mass., JOWATHERM from Jowat Corp. of High Point, N.C.; IPATHERM from H. B. Fuller Company of St. Paul, Minn.; or moisture curing hot melt compositions.

The seam is formed by applying a thermoplastic polyurethane to the fabric side of the bottom layer. A second layer is then placed on top of the bottom layer and adhesive with the fabric side down. The package is then placed into a heated press at least 190° C. for at least 2 seconds, and preferably at 200° C. for 3–5 seconds. The sealed package is then cut into the shape of a glove insert. Typical seam width comprises 1.5 to 5 mm and preferably 2.5 to 3.5 min. Alternatively, the seam may be formed by applying a moisture curing hot melt composition and pressing at least 100° C. for at least 2 seconds, and preferably at 125°–150° C. for about 3–5 seconds.

Preferably, a pressure is applied to the material during this process of at least 200 lbs/in$^2$ gauge. The preferred pressure is 300 to 400 lbs/in$^2$ or above.

This process causes the adhesive layer to flow around the fibers of the backing material so as to produce a viral resistant barder layer. Suitable knit backing materials include polyester warp knits and nylon warp knits from Native Textiles of Glens Falls, N.Y., or circular polyester knits and nylon knits from Milliken Chemical Div., Milliken & Co., of Spartanburg, S.C. Moreover, the adhesive also flows into the interior of the fiber bundles so to constrict or eliminate passageways through the seam (i.e., reducing voids through the material to less than 10 micron in diameter; and preferably less than 5 micron in diameter). This process is referred to as "fully encapsulating" the fibers. Seams made in accordance with this procedure are resistant to virus penetration and will pass ASTM Standard ES22, as outlined below.

Figure 4:
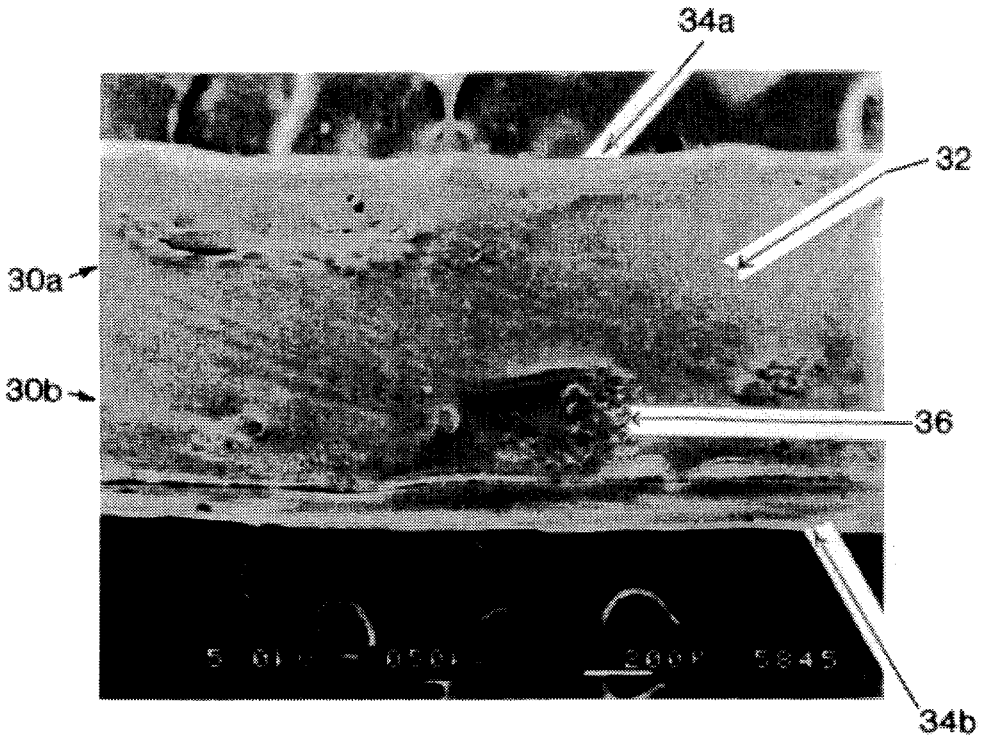
FIG. 4 is an SEM enlarged 50 times of a cross-section of a seam from one embodiment of a glove of the present invention.
Figure 5:
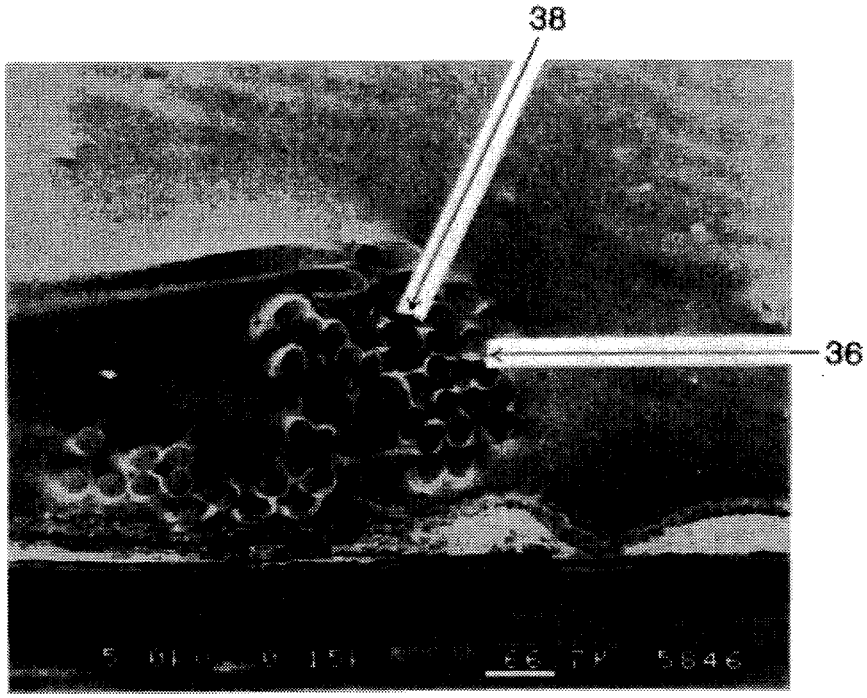
FIG. 5 is an SEM enlarged 150 of a portion of the seam shown in FIG. 4.

The improved seams of the present invention can be seen in the SEMs of FIGS. 4 and 5. Two knit backing layers 30*a*; 30*b* are again bonded together and permeated with a continuous adhesive layer 32. Each backing layer 30*a*, 30*b* is adhered to an expanded PTFE membrane 34*a*, 34*b*. Numerous fiber bundles 36 run through the backing layers 30*a*, 30*b* and these are surrounded by the adhesive material. Unlike conventional seams, however, the adhesive layer fully permeates inside of the fiber bundles 36, fully encapsulating the fibers so as to eliminate or greatly reduce the passageways 38 through the seam to the order of less than 10 micron in diameter. The result of this procedure is the creation of seams that will consistently resist the passage of viruses and similar microscopic contaminants.

Similar exceptional results may also be achieved through the processing of a non-woven backing material in accordance with the present invention. Suitable non-woven backing materials include spun bonded and meltblown materials from Fiberweb North Amedca, Inc. of Simpsonville, S.C. These materials may be filled with adhesive in the same manner previously described. Preferably, the process for adhesive application of a non-woven material comprises:

The seam is formed by applying a thermoplastic polyurethane to the fabric side of the bottom layer. A second layer is then placed on top of the bottom layer and adhesive with the fabric side down. The package is then placed into a heated press at least 190° C. for at least 2 seconds, and preferably at 200° C. for 3–5 seconds. The sealed package is then cut into the desired shape, e.g., as a glove insert. Typical seam width comprises 1.5 to 5 mm and preferably 2.5 to 3.5 mm. Alternatively, the seam may be formed by applying a moisture curing hot melt composition and pressing at least 100° C. for at least 2 seconds, and preferably at 125°–150° C. for 3–5 seconds.

Preferably, a pressure is applied to the material during this process of at least 200 lbs/in$^2$ gauge. The preferred pressure is 300 to 400 lbs/in$^2$ or above.

Figure 6:
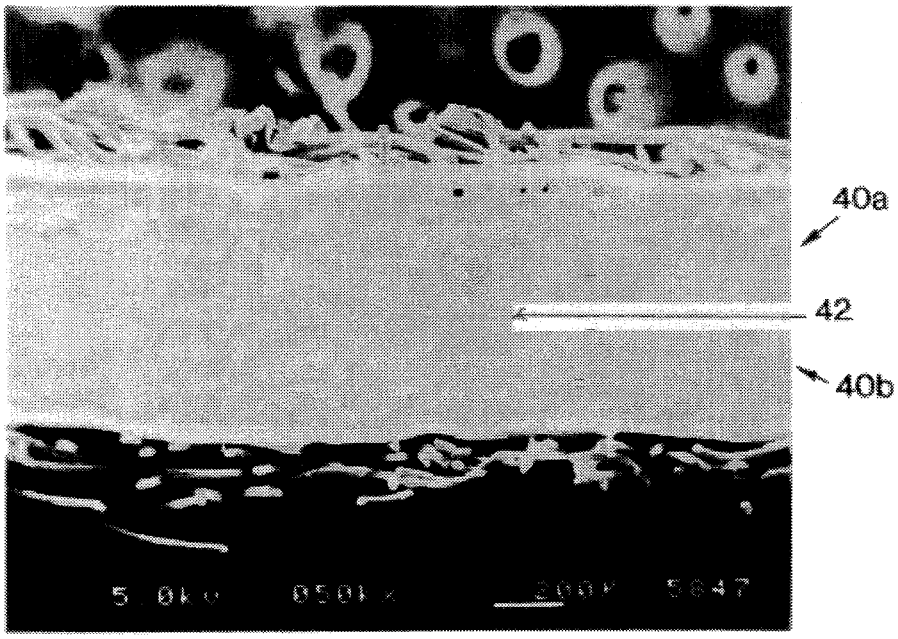
FIG. 6 is an SEM enlarged 50 times of a cross-section of a seam from another embodiment of a glove of the present invention.
Figure 7:
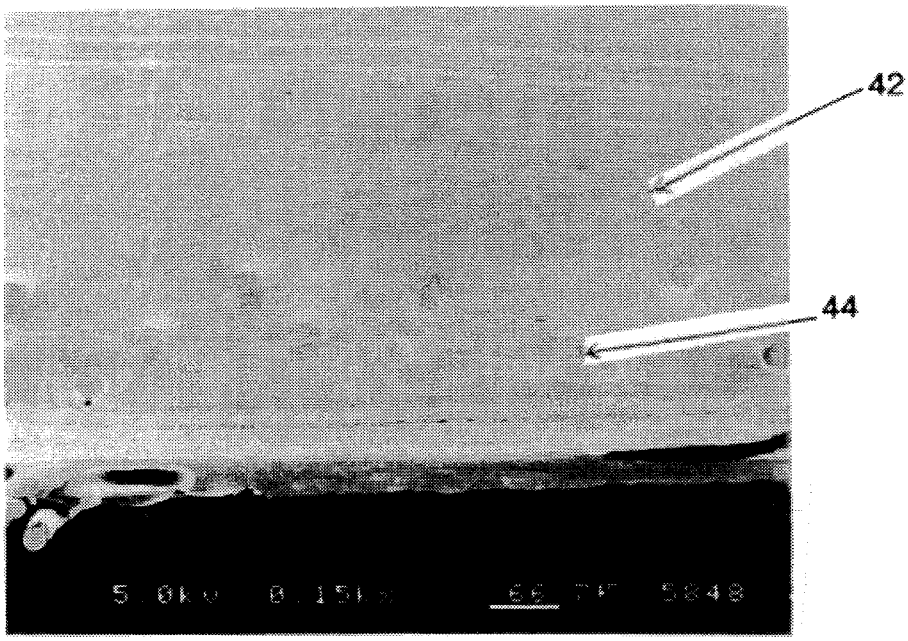
FIG. 7 is an SEM enlarged 150 times of a portion of the seam shown in FIG. 6.

As is shown in FIGS. 6 and 7, when a seam is made in this manner, each layer of backing material 40*a*, 40*b* is bonded to each other by adhesive 42. The adhesive 42 completely fills in between fibers 44 in the non-woven and seals against any leakage that might otherwise occur through the seam. Once fully encapsulated in this manner, any voids remaining through the seam comprise less than 10 micron in diameter. More preferably, voids left through the seam are maintained at a level of less than 5 micron in diameter.

Exceptional results may also be achieved through the processing of a woven backing material in accordance with the present invention. Suitable woven backing materials include woven polyester and woven nylons available from Milliken Chemical Div., Milliken & Co., of Spartanburg, S.C.

It should be understood that the present invention may be practiced with a wide variety of protective cover constructions. Possible applications include: gloves, glove inserts, booties, boot inserts, pants, waders, jackets, coveralls, masks, equipment covers, bags, tubes, socks, pouches. Such covers may be constructed from two or more separate pieces of fabric or fabrics (with either all or only some of the fabric being composite fabric of the present invention) with segments of each of the fabric pieces joined to each other with seams made in accordance with the present invention. Additionally, or alternatively, a single fabric piece may be joined to itself at two different segments using a seam of the present invention.

It is contemplated to be within the scope of the present invention to employ it with any form of breathable fabric laminates. In addition to coated or uncoated expanded PTFE laminates, other breathable and liquid resistant laminate materials that may be employed with the present invention include continuous polyurethane sheets.

Without intending to limit the scope of the present invention, the following examples illustrate how the present invention may be made and used:

EXAMPLE 1

Two layers of a spun bonded nylon non-woven laminate structure are used to construct an adhesive sealed insert. A thermoplastic polyurethane adhesive for the seam is heated to 200° C. and applied in the shape of a glove hand to the bottom layer of laminate structure on the non-woven side. A top layer of the laminate structure is laid on top of the adhesive such that the nonwoven side is facing towards the adhesive. Pressure and heat are applied to the two layers of laminate structure and the adhesive so that the adhesive will encapsulate the fibers of the non-woven. The pressure is 400 lbs/in.$^2$ gauge and the heat is 200° C. The heat and pressure are applied for a time period of 3 seconds. The sealed laminate structures are then cut out around the periphery of the adhesive seam. Cutting is performed by stamping the laminate structures with a steel rule die. The finished product is an insert sealed in the shape of a glove hand.

EXAMPLE 2

Two layers of the nylon warp knit laminate structure are then used to construct an adhesive sealed insert. The moisture curing hot melt adhesive for the seam is heated to 150° C. applied in the shape of a glove hand to the bottom layer of laminate on the knit side. A top layer of the laminate structure is laid on top of the adhesive such that the knit is facing towards the adhesive. Pressure and heat are applied to the two layers of laminate structure. The pressure is 400 lbs/in.$^2$ gauge and the heat is 125° C. The heat and pressure are applied for a time period of approximately 3 seconds. The sealed laminate structures are then cut out around the periphery of the adhesive seal. Cutting is performed by stamping the laminate structures with a steel rule die. The finished product is an insert sealed in the shape of a glove hand.

EXAMPLE 3

Two layers of the nylon warp knit laminate structure are then used to construct an adhesive sealed insert. The adhesive for the seam is heated to 200° C. for a thermoplastic polyurethane and applied in the shape of a glove hand to the bottom layer of laminate on the knit side. A top layer of the laminate structure is laid on top of the adhesive such that the knit is facing towards he adhesive, Pressure and heat are applied to the two layers of laminate structure. The pressure is 400 lbs/in.$^2$ gauge and the heat is 200° C. The heat and pressure are applied for a time period of approximately 3 seconds. The sealed laminate structures are then cut out around the periphery of the adhesive seal. Cutting is performed by stamping the laminate structures with a steel rule die. The finished product is an insert sealed in the shape of a glove hand.

EXAMPLE 4

Two layers of a three layer spun bonded nylon non-woven laminate structure are used to construct an adhesive sealed insert. The three layers consisted of two layers of non-woven laminated to each side of the oleophobic coated PTFE film. The moisture curing hot melt adhesive for the seam is heated to 150° C. and applied in the shape of a glove hand to the bottom layer of laminate structure on the non-woven side. A top layer of the laminate structure is laid on top of the adhesive such that the non-woven side is facing towards the adhesive. Pressure and heat are applied to the two layers of laminate structure and the adhesive so that the adhesive will encapsulate the fibers of the non-woven. The pressure is 400 lbs/in.$^2$ gauge and the heat is 150° C. The heat and pressure are applied for a time period of 4 seconds. The sealed laminate structures are then cut out around the periphery of the adhesive seam. Cutting is performed by stamping the laminate structures with a steel rule die. The finished product is an insert sealed in the shape of a glove hand.

The success of the seams made in accordance with the present invention may be better understood by review of ASTM Standard ES22, as set forth below, and through comparative test results.

ASTM STANDARD ES22

ASTM Standard ES22, incorporated by reference, was developed by ASTM Subcommittee F23.40 on Biological Hazards to provide a determination as to whether a material is effective at preventing penetration of a virus in a body fluid simulant. This standard works under the following principles and has been adapted in the manner described below to address the concerns of the present invention. Blood borne pathogens of major concern are the hepatitis B virus (HBV), hepatitis C virus (HCV) and human immunodeficiency virus (HIV). HBV is enveloped, spherical, and 42–47 nm (nanometers) in size. HCV has no envelope, icosahedral morphology, and is 30–60 nm in size. HIV is enveloped, spherical, and is 80–110 nm in size. The blood serum concentrations of these three blood borne pathogens range from less than 100 to more than 100 million IU/ml (infectious units per milliliter). The ϕX174 bacteriophage is one of the smallest known bacteriophages. It has no envelope, has icosahedral morphology, and is 25–27 mm in size. The ϕX174 bacteriophage challenge suspension will be maintained at a concentration of at least 1.0×108 PFU/ml (plaque forming units/ml).

In order to test a membrane to determine resistance to bateriophages of these kinds, test specimens are prepared by randomly cutting the protective material into approximately 75 mm×75 mm swatches. Test specimens are then sterilized with ethylene oxide gas and degassed for 48 hours minimum prior to testing. Other methods of sterilization may be used as desired and appropriate.

Test specimens are challenged with approximately 60 ml of a ϕX174 bacteriophage suspension for 5 minutes at atmospheric pressure, 1 minute at 2.0 PSIG (13.8 kPa), and 54 minutes at atmospheric pressure or until liquid penetration is observed. At the conclusion of the test, the observed side of the test specimen is rinsed with a sterile medium and then assayed for the presence of the ϕX174 bacteriophage. The surface tension of the challenge suspension and the assay medium is adjusted to approximately 40–44 dynes/cm using surfactant-type TWEEN® 80 at a final concentration of approximately 0.01% by volume.

The materials tested are intended to provide protection against blood, body fluids, and other potentially infectious materials. The surface tension range for blood and body fluids is approximately 42–60 dynes/cm. Therefore, in order to simulate the wetting characteristics of blood and body fluids, the surface tension of the ϕX174 bacteriophage suspension is adjusted to approximate the lower end of this surface tension range (40–44 dynes/cm).

The choice of a microbiological model to evaluate the effectiveness of the blood-borne pathogen barrier properties of protective clothing materials is important. There are problems associated with utilizing the actual blood borne pathogens as test organisms. HBV and HCV cannot be grown in the laboratory. HIV represents a significant safety and liability consideration due to its high infectivity potential and requirements for extreme and expensive precautions. Therefore, a model for the blood borne pathogens has been developed. The ideal properties of a surrogate include small size, spherical or polyhedral (round) morphology, environmental stability, low or non-human infectivity, high assay sensitivity, rapid growth, and high titer. The ϕX174 bacteriophage was selected as the most appropriate surrogate for the blood borne pathogens mentioned because it satisfies all of these criteria. The ϕX174 bacteriophage has no envelope and is 25–27 mm in size (similar to HCV, the smallest pathogen), has an icosahedral or nearly spherical morphology similar to all three viral pathogens mentioned, has excellent environmental stability, is non-infectious to humans, has a limit of detection which approaches a single virus particle, grows very rapidly (assay results can be read within as little as 4–8 hours), and can be cultivated to reach very high titers similar to HBV (the most concentrated pathogen mentioned).

Animal virus surrogates are not used as they require specialized cell culture and enzyme assay techniques. In addition, the stability of most of the animal viruses is less than desirable and plating efficiency is low or unknown. Despite the variety of viral coats or surfaces (i.e., lipophilic, hydrophilic, etc.,) they generally perform similarly in barrier or penetration tests. This is because viruses adopt the charge of the liquid in which they are suspended and are more affected by the liquid vehicle than by their own physical or chemical properties.

It is also important to note that blood as the test vehicle, while it may seem appropriate, is actually a poor choice. Many viruses adsorb to blood cells. Red blood cells are about 7–10 μm in diameter and can actually plug pores. Since many other body fluids can be infectious, it is more severe to use a body fluid simulant such as that described in this procedure.

To test the material and seams in the context of the present invention the following apparatus is employed:

Chemical Penetration Cell(s) made in accordance with ASTM F903, incorporated by reference;

An air pressure source;

An incubator capable of 37° C.±2° C;

A water bath capable of 45° C.±2° C;

An analytical balance capable of measuring 0.001 g;

A vortex mixer;

A refrigerator capable of maintaining 2°–6° C.;

An autoclave capable of sterilizing at 121° C.;

A centrifuge capable of 5000×G;

An electronic timer;

An orbital shaker;

A pH meter sensitive to 0.1 pH units;

An ethylene oxide sterilizer.;

Sterile petri dishes, 15×100 mm;

Sterile 1, 5, 10 ml pipettes;

13×100 mm test tubes;

Stainless steel test tube rack;

0.45 μm and 0.22 μm membrane filters;

Sterile glass bottles, 100 ml–500 mL;

Sterile funnel or syringe;

Polyethylene material;

Microporous membrane material;

Retaining screen;

TWEEN® 80 Reagents, acquired from ICI Americas of Wilmington, Del. ϕX174 Bactedophage ATCC #13706-BI;

*E. coli* C ATCC #13706;

Nutrient Broth;

Nutrient Broth with 0.1% TWEEN® 80;

Nutrient Broth with 0.01% TWEEN® 80;

Bottom agar;

Top agar.

To carry out the bacteriophage test, the following procedure is used:

Test specimens are prepared by randomly cutting the protective clothing materials into approximately 75 mm×75 mm swatches. Test specimens, including test controls, are sterilized with ethylene oxide according to the following parameters:

Preconditioning: 30 minutes minimum.

Temperature: 52° C.+/–2° C.

Relative Humidity: 55+/–10%.

Gas Pressure: 15 PSIG.

Exposure Time: 8 hours minimum.

Degassing Time: 48 hours min. @54° C.+/–2° C.

Prior to testing, all test specimens and controls should be conditioned for a minimum of 24 hours at 21° C.+/–5° C. and 30% to 80% relative humidity. To prepare the ϕX174 bacteriophage, 100 ml of nutrient broth is inoculated with *E. coli* C and incubated approximately 6–18 hours at 37° C.+/±2 C. with shaking. A 1:100 dilution of the culture is prepared and incubated for approximately 90 minutes at 37° C.+/±2° C. The culture is then inoculated with 0.5 ml of the ϕX174 bacteriophage stock (ATCC# 13706-BI). The suspension is then incubated with rapid shaking for approximately 1 to 5 hours at 37° C.+/± 2 C. Complete lysis of the host bacteria can be noted when the broth clears. The virus suspension is then centrifuged at 5000×G for about 20 minutes. Supernatant is filtered through a sterile 0.45 μm filter and then through a 0.22 pm filter to remove the host cell debris. The ϕX174 stock culture is then refrigerated at 2°–8° C. The stock culture may be titered periodically to verify concentration.

The ϕX174 culture is diluted in sterile nutrient broth with 0.01% TWEEN® 80 to provide a challenge concentration of $\geqq 1\times10^8$ PFU/mL and a final TWEEN® 80 concentration of approximately 0.01%.

A test apparatus is used in accordance with ASTM F903. The apparatus is steam sterilized at 121° C. for 30 minutes minimum. This includes the cell support, TEFLON® cell, gaskets, retaining screen, drain valve, air line connector, stainless steel flange, and nuts.

After the test cells cool to room temperature, the sterile test specimen is placed into the penetration cell with the normal outside surface of the specimen oriented toward the test cell reservoir. The seam of the material should be oriented approximately in the middle of the test cell. The inner side surface of the specimen is observed for liquid penetration.

The layers should be clamped into the test cell in the following order:

TEFLON® cell;

Gasket;

Test sample;

Gasket;

Retaining screen/scrim;

Gasket;

Stainless steel flange;

Plexiglas shield (optional).

Due to the presence of a seam, some specimens may not clamp properly into the penetration test cell using the method described above, resulting in possible false positives due to "wicking." Some specimens which exhibit problems of wicking can be tested using the ASTM ES21 Synthetic Blood Penetration method, incorporated by reference, to verify that wicking is occurring. If the specimen exhibits wicking it may be necessary to seal the edges of the specimen with adhesive or paraffin wax prior to testing. Other methods of clamping may be used if verified to be effective and valid. Each of the bolts in the test cell is torqued to 120 inch pounds, using a criss-cross technique. The test cell is then placed into the test apparatus and the drain valve is closed.

The test cell reservoir is filled with approximately 60 ml of the ϕX174 challenge suspension. An aliquot of the suspension should be taken and titered to determine the initial challenge concentration. The exposed surface of the specimen is observed for liquid penetration, while allowing the specimen to sit for 5 minutes at atmospheric pressure. If liquid penetration is observed, the test is terminated and assayed for ϕX174.

If no liquid penetration occurs, the air line is connected to the test cell at the top port and the air regulator is slowly opened to increase the pressure to 2.0 PSIG (13.8 kPa) no faster than 0.5 PSIG/sec. The surface of the specimen is again observed for liquid penetration. If liquid penetration is observed, the test is terminated and assayed for ϕX174 immediately. With no penetration, the pressure (2.0 PSIG) is held constant for exactly 1 minute and the surface of the specimen is continued to be monitored for liquid penetration. If liquid appears on the surface of the specimen, terminate the test immediately and assay for ϕX174.

With no liquid penetration, the pressure regulator is turned until the pressure in the test cell is released. The air line is now disconnected. The test specimen and cell are then allowed to sit for 54 minutes at atmospheric pressure. The surface of the specimen is observed periodically for liquid penetration.

To comply with the ASTM ES22 Test Method, three replicate specimens should be tested for each type of specimen tested.

A control "blank" should be included with each triplicate testing group. The control "blank" consists of a sterile test specimen or polyethylene swatch placed into the test cell as previously described, however, no ϕX174 challenge is added to the test cell reservoir. Instead, stedle nutrient broth with 0.01% TWEEN® 80 is added. At the conclusion of the test period, the control "blank" is assayed as outline in the assay procedure. If the assay results of the control "blank" shows any plaques, the test run is considered invalid.

A negative control should also be included in the study to show that a negative result can be obtained consistently for some impervious materials when challenged with the ϕX174 bacteriophage. The negative control material should be a heavy gage polyethylene film or the like that can pass the test by not allowing any ϕX174 penetration.

A positive control should also be included in the study to show that the ϕX174 bacteriophage can be recovered using the assay procedure described. The positive control specimen should consist of a material that allows ϕX174 passage, a 0.040 μm microporous membrane has been found to be acceptable.

Fallout plates should also be strategically placed on the work bench area to determine the background counts (if any) from airborne contamination of ϕX174. Fallout plates should consist of bottom agar plates overlaid with 2.5 mL molten top agar (45° C.±2° C.) and 1–2 drops *E. coli* C.

After the 54 minute test interval or when liquid penetration is observed, the drain valve is opened and the challenge solution is drained from the test cell reservoir. The challenge collected from the test cells is titered to determine the final challenge concentration of the ϕX174 suspension.

The test cell is then turned to a horizontal position and 5 ml of sterile nutrient broth with 0.01% TWEEN® 80 is slowly added onto the surface of the specimen. The test cell is gently swirled for approximately 1 minute to ensure contact of the assay fluid with the entire viewing surface of the test sample. Using a sterile pipette, the assay fluid is removed and transferred to a sterile container. The liquid is assayed soon after collecting. If a long period of time elapses between sampling and assaying of the liquid it will be necessary to demonstrate stability of the ϕX174 bacteriophage. Finally, the specimen is removed from the test cell and the test cell is prepared for sterilization.

To determine plaque assay, dispense 2.5 ml of molten top agar into sterile test tubes and hold top agar at 45° C.+/–2° C. in a water bath. Next, add 0.5 ml aliquots of the assay fluid to three top agar tubes and add 1–2 drops of the *E. coli* C culture to each of the test tubes. The contents of tubes are mixed well and poured over the surface of the bottom agar plates.

The agar is allowed to solidify on a level surface and incubate at 37° C.+/–2 C. for 12–24 hours. The length of time depends on having the plaques large enough to count but not merging. The remaining assay fluid for all test specimens is retained in the refrigerator (2–8° C.) until accurate counts are confirmed.

Finally, the plaques are counted and the challenge titer is calculated. Results are reported as PASS or FALL. If assay plates are TNTC (Too Numerous To Count), additional sedal 1 to 10 dilutions are prepared in peptone water of the remaining assay fluid and assayed. The challenge titer of the challenge collected is determined from the test cells before and after the testing period. The final titer of the challenge should be $\geqq 1\times10^8$ PFU/ml to be considered a valid test run. If a significant drop in the challenge titer is observed after the 60 minute test period, a material compatibility study should be performed to determine if the material is adversely effecting the ϕX174 bacteriophage.

The following equation is used to calculate the challenge and assay titers:

$$= \frac{(\text{Ave \# of } PFU\text{'s per plate}) \times (\text{Dilution})}{(\text{Ave mL plated})}$$

Using the above test procedures on various material seams, comparative results have been achieved as is explained below.

TABLE 1

| Laminate Material | Number tested | ASTM Standard ES22 results |
|---|---|---|
| Conventional ePTFE fireglove insert | 15 | 1 pass/14 failure |
| Example 1 | 2 | 2 pass |
| Example 2 | 15 | 15 pass |
| Example 3 | 5 | 5 pass |
| Example 4 | 6 | 6 pass |

While particular embodiments of the present invention have been illustrated and described herein, the present invention should not be limited to such illustrations and descriptions. It should be apparent that changes and modifications may be incorporated and embodied as part of the present invention within the scope of the following claims.

The invention claimed is:

1. A protective cover comprising laminate material including at least one layer of breathable and liquid resistant sheet material and at least one layer of fibrous material to which the sheet material is affixed, the sheet material being impenetrable to viruses, and including a first segment of laminate material and a second segment of laminate material;

at least one seam joining the first and second segments of the laminate material together, the laminate material oriented to adjoin a layer of fibrous material from the first segment to the layer of fibrous material from the second segment;

wherein the seam comprises a continuous layer of adhesive applied between the first and second segments of the laminate material, the adhesive fully penetrating through each layer of fibrous material to the affixed layer of the sheet material;

wherein the adhesive fully encapsulates fibers in the fibrous material layer; and wherein any voids present in a cross-section of the seam measure less than 10 micron across.

2. The cover of claim 1 wherein the sheet material comprises an expanded polytetrafluoroethylene; and the fibrous material is selected from the group of woven fabric, non-woven fabric, or knit.

3. The cover of claim 2 wherein the cover is both liquid water impermeable and water moisture vapor permeable.

4. The cover of claim 1 wherein the adhesive is selected from the group consisting of moisture curing and thermoplastic polyurethane.

5. The cover of claim 1 wherein the seam comprises a bead of adhesive material at least 1.5 to 5 mm wide.

6. The cover of claim 1 wherein the cover comprises a glove, the first segment of laminate being an outline of a hand and the second segment of laminate being a mirror image of the first segment.

7. The cover of claim 6 wherein the first segment of laminate and the second segment of laminate comprise separate sheets of material;

the seam comprises a continuous bead of adhesive material at least 1.5 mm wide; and the bead of adhesive material traces the outline of the hand so as to form a sealed pocket into which a human hand may be inserted.

8. The cover of claim 6 wherein the sheet material comprises an expanded polytetrafluoroethylene; and the fibrous material comprises a non-woven fabric.

9. The cover of claim 8 wherein the cover is both liquid water impermeable and water moisture vapor permeable.

10. The cover of claim 1 wherein any voids present in the cross-section of the seam measure less than 5 microns across.

11. A method for producing a cover in accordance with claim 1 that comprises:

providing the first segment of laminate material and the second segment of laminate material;

applying a continuous bead of adhesive to the first segment of laminate along an intended line of the seam;

mounting the first and second segments of laminate material together with their fibrous layers abutting one another;

applying heat and pressure to the seam to adhere the two segments together, the adhesive fully penetrating through each layer of fibrous material to the affixed layer of the sheet material and fully encapsulating the fibers in the fibrous material layer, wherein any voids present in a cross-section of the seam measure less than 10 micron across.

12. The method of claim 11 that further composes:

providing an adhesive of thermoplastic polyurethane;

applying heat of at least 190° C. and pressure of at least 200 lbs/in sq gauge for a period of at least 2 seconds.

13. The method of claim 11 that further composes:

providing an adhesive of moisture cure;

applying heat of at least 100° C. and pressure of at least 200 lbs/in sq. gauge for a period of 2 seconds.

14. The method of claim 11 that further comprises:

producing the seam wherein any voids present in a cross-section of the seam measure less than 5 microns across.

* * * * *